United States Patent [19]

Elguindy et al.

[11] 4,087,939

[45] May 9, 1978

[54] DOOR OPERATOR WITH LOCKING MECHANISM

[75] Inventors: Samir Mostafa Elguindy, Mount Prospect; Kristupas Daugirdas, Wilmette, both of Ill.

[73] Assignee: Vapor Corporation, Chicago, Ill.

[21] Appl. No.: 767,686

[22] Filed: Feb. 11, 1977

[51] Int. Cl.[2] ..... E05F 17/00

[52] U.S. Cl. ..... 49/118; 49/122; 49/280

[58] Field of Search ..... 49/13, 280, 274, 281, 49/118, 122

[56] References Cited

U.S. PATENT DOCUMENTS

| | | | |
|---|---|---|---|
| 2,419,964 | 5/1947 | Newkirk | 49/280 X |
| 2,893,506 | 7/1959 | Daugirdas | 49/13 X |
| 3,202,414 | 8/1965 | Simmons et al. | 49/280 |

*Primary Examiner*—Kenneth Downey
*Attorney, Agent, or Firm*—Francis J. Lidd

[57] ABSTRACT

Door operator for doors on a passenger carrying vehicle such as a bus or the like for moving a door between open and closed positions and having a locking mechanism with a lost motion action for unlocking the doors prior to the door opening cycle.

22 Claims, 19 Drawing Figures

(DOORS CLOSED AND LOCKED)

(DOORS CLOSED AND UNLOCKED)

(DOORS FULLY OPEN)

(DOORS ABOUT TO BE CLOSED & LOCKED)

FIG. 11
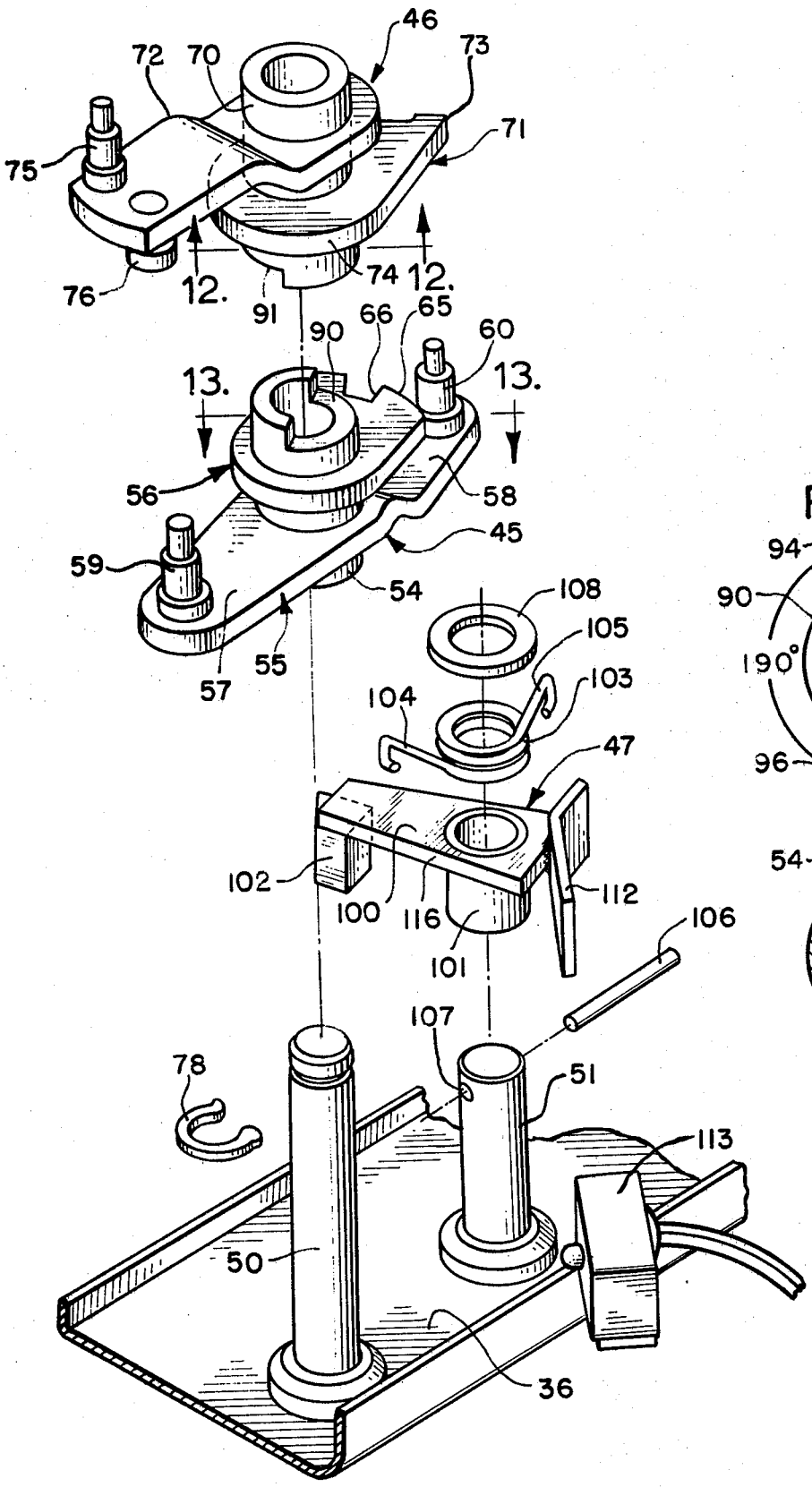
FIG. 12
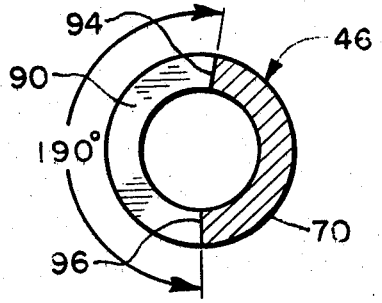
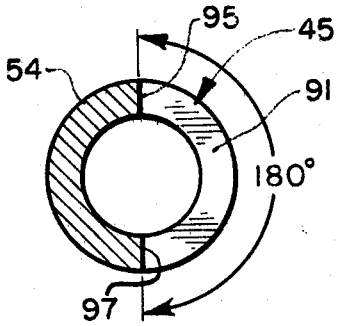
FIG. 13

(DOOR CLOSED AND LOCKED)

(DOOR CLOSED AND UNLOCKED)

(DOOR FULLY OPEN)

DOOR OPERATOR WITH LOCKING MECHANISM

This invention relates in general to a door operator for passenger carrying vehicles, and more particularly to a door operator having a positive mechanical locking mechanism operable during a lost motion action of the operator.

While the door operator of the present invention is especially suitable for passenger carrying vehicles such as buses or the like, it should be appreciated that it may be used to control the opening and closing of doors on any vehicle or in a stationary structure. Specifically, the door operator, when on vehicles, may be of a type to be operated when a passenger actuates a touch bar to open the door, wherein a suitable prime mover effects the opening cycle and thereafter a spring return mechanism effects the closing cycle, or it may be of a type that drives the door or doors between open and closed positions. The prime mover may be in the form of a pneumatic, hydraulic or electric motor. At the beginning of the door opening cycle and at the beginning of the door closing cycle, take-up in a lost motion connection is effected. A positive locking mechanism responsive to the door operator is mechanically actuated for respectively unlocking and locking the door operator. The term "opening cycle" as used herein embraces the driving cycle of the prime mover for the operator effected for opening a door or doors, it being appreciated that the linkage connected to the door does not move during the take-up of the lost motion connection. Only the locking mechanism is actuated during the take-up of the lost motion connection, and during the opening cycle the locking mechanism is actuated to unlock position. Similarly, the "closing cycle" as used herein embraces the return cycle of the operator, it being appreciated the door is in open position during the reverse take-up of the lost motion connection. The locking mechanism is actuated into locking position at the end of the closing cycle.

Heretofore, it has been known to normally lock and unlock power operated doors on vehicles by using an auxiliary solenoid. It has also been known to use overcenter locking mechanisms in door operators for locking the doors in closed position. Examples of solenoid locking door operators are shown in U.S. Pat. Nos. 2,893,506 and 3,381,010, while an example of an overcenter locking door operator is shown in U.S. Pat. No. 3,537,403. It has also been known to provide a power open spring return door operator such as shown in U.S. Pat. No. 3,010,433.

One form of door operator having the locking mechanism of the present invention is of the power open spring return type and includes a simple but positive locking mechanism operable by the door operator itself during the initiation of the opening cycle and the completion of the closing cycle, thereby eliminating the need for a separate power unit for locking the doors in closed position and also eliminating the use of an overcenter locking mechanism which is objectionable on the basis that it develops a high force at the end of the closing travel of a door driven by an operator. The locking mechanism according to the present invention is therefore mechanically actuated by the operator. While the door operator of the present invention is shown in one form to be pneumatically operated during the opening cycle, as already mentioned, it should be appreciated that the locking mechanism of the present invention, being integral with the door operator and powered thereby, reduced the overall cost of the door operator as well as the maintenance requirements, and further reduces the space for the operator.

This operator includes primary and secondary hub members pivotally mounted on a shaft and drivingly interconnected so that there is a lost motion connection therebetween, whereby a locking mechanism is actuated to unlocking position during take-up of the lost motion connection at the beginning of the opening cycle and actuated to locking position at the end of the closing cycle. A cam arrangement is provided for actuating the locking mechanism into unlocking position, while a spring means serves to bring the locking mechanism back into locking position when the cam means is moved to an inactive position. A spring is provided for returning the door operator through the closing cycle after it has completed the opening cycle. Where the operator of the present invention utilizes pneumatic power for driving it through the opening cycle, it may be referred to as an air open spring return door operator.

The locking mechanism of the invention may also be utilized on the usual type of door operator where the door moves alongside the operator when moving to open position, such as shown in U.S. Pat. No. 3,782,034. This type of operator includes a drive arm or multiplying lever which includes a roller operating in a track connected to the door wherein oscillation of the drive arm causes opening and closing of the door. The drive shaft of the operator includes a combination cam locking and drive member coacting with a stop or lug extending from the drive arm to produce the lost motion action and to mechanically control the position of a locking pawl between lock and unlock positions in essentially the same manner as the locking mechanism above described. Accordingly, during initial movement of the drive shaft, the lost motion action occurs and during take-up thereof the locking pawl is driven to the unlock position prior to interconnection between the drive shaft and the drive arm. Further, at the completion of the closing cycle, the cam locking and drive member permits the locking pawl to move into lock position.

It is therefore an object of the present invention to provide a new and improved simple and inexpensive locking mechanism for a door operator.

Another object of the present invention is in the provision of a mechanical locking mechanism for a door operator that is self-actuated by the operator.

It is a further object of the present invention to provide a mechanical locking mechanism for an operator that is air powered during the opening cycle and spring powered during the closing cycle and wherein the locking mechanism is built in and operable between lock and unlock positions during the beginning of the opening cycle and at the end of the closing cycle.

Another object of the invention is in the provision of a door operator having a locking mechanism operated to unlock position during the take-up of a lost motion connection in the drive mechanism of the operator.

A still further object of the invention resides in the provision of a door operator having a lost motion drive connection that enables the doors operated thereby to open slightly when in locked position.

Other objects, features and advantages of the invention will be apparent from the following detailed disclosure, taken in conjunction with the accompanying sheets of drawings, wherein like reference numerals refer to like parts, in which:

FIG. 7 illustrates the position of the door operator elements when the doors are closed and locked;

FIG. 8 illustrates the position of the door operator elements when the doors are closed and unlocked;

FIG. 9 illustrates the position of the door operator elements when the doors are in fully open position;

FIG. 10 illustrates the position of the door operator elements when the doors are in closed position and about to be locked;

FIG. 11 is an enlarged exploded perspective view of the door operator according to the invention but omitting the linkages connecting to the doors and the linkage connection to the power source;

FIG. 12 is an enlarged plan view of the drive hub illustrating the arcuate extent of the slot or notch;

FIG. 13 is an enlarged plan view of the driven hub illustrating the arcuate extent of the slot or notch;

The door operator of the invention is especially useful for operating doors in passenger carrying vehicles such as buses, as already mentioned, and therefore will be further described as controlling the operation of a pair of doors in the form of door leaves movable between open and closed positions relative an opening in the side wall of a bus. While the operator will be illustrated as controlling the operation of a pair of door leaves, it can be appreciated that it may also be used for controlling the operation of a single door leaf for an opening.

Figure 1:
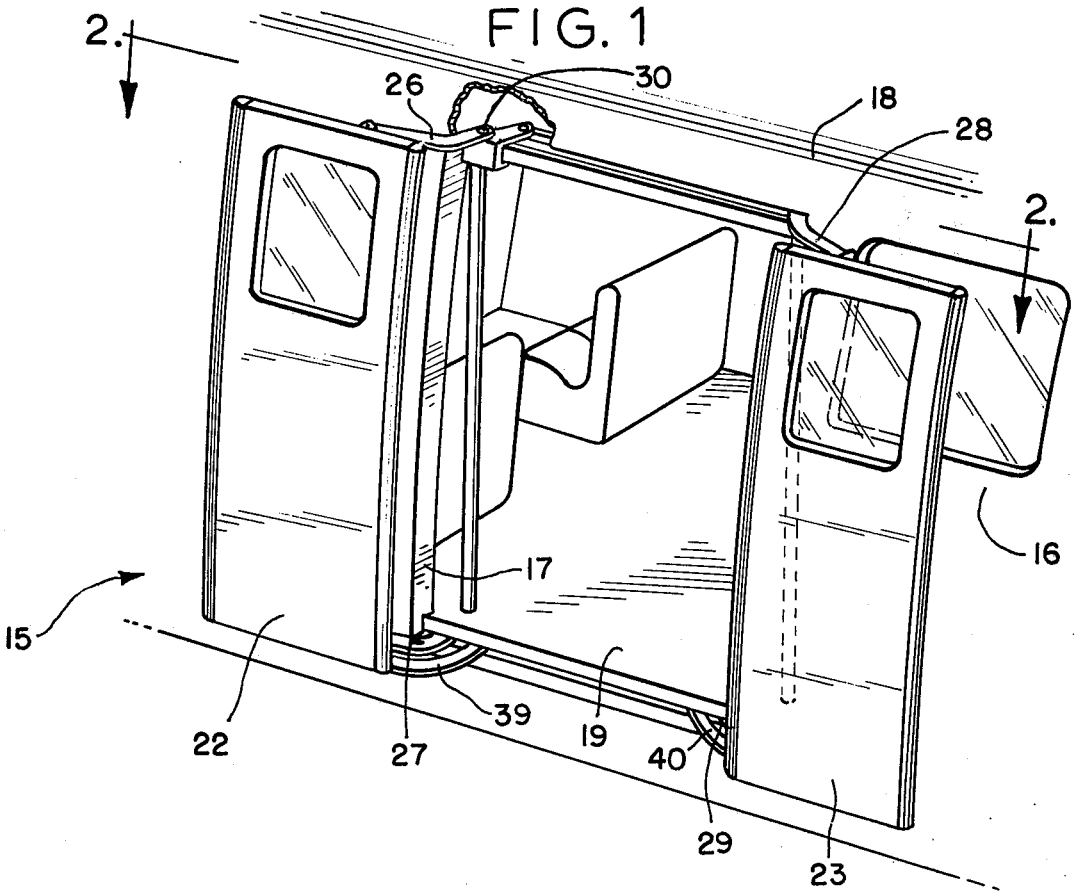
FIG. 1 is a fragmentary perspective view of a vehicle having a door operator according to the invention for operating a pair of doors which are shown in open position and with a portion of the vehicle wall broken away to show underlying parts of the operator linkage.
Figure 2:
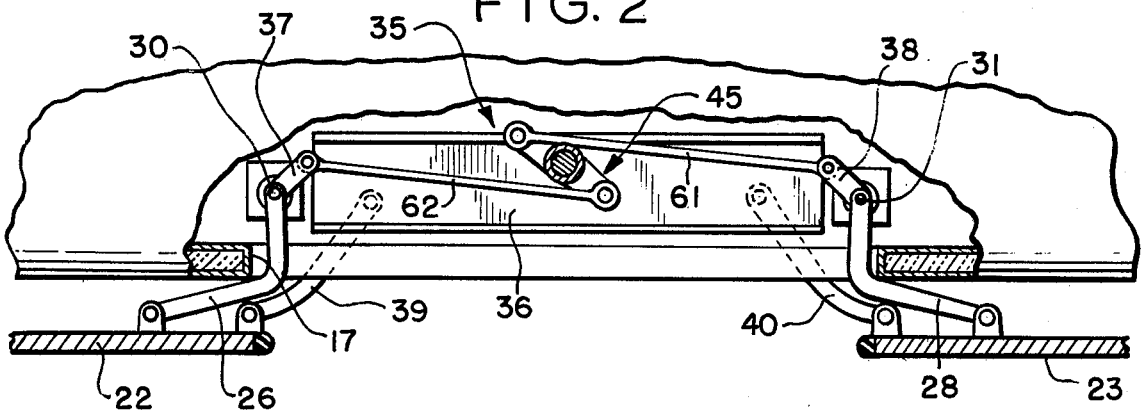
FIG. 2 is a top plan view of the door operator according to the invention with parts omitted for purposes of simplicity and taken substantially along line 2—2 of FIG. 1 while showing the doors in open position.
Figure 3:
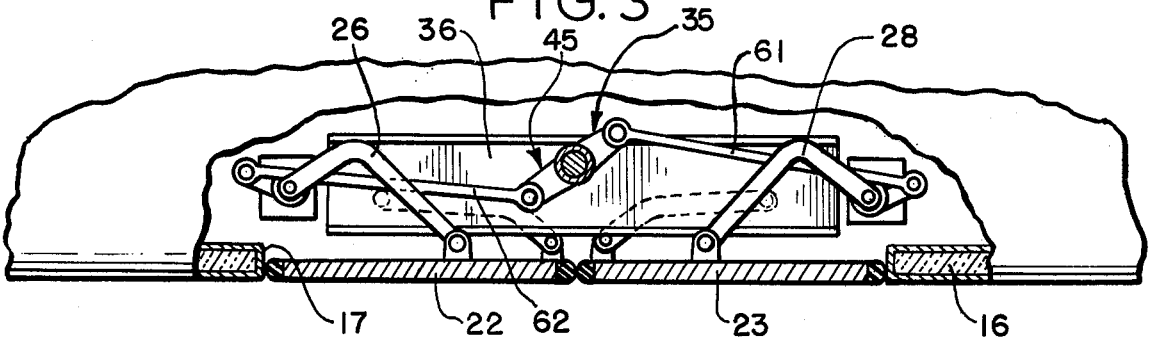
FIG. 3 is a view similar to FIG. 2 but showing the doors in closed position.

Referring specifically to FIGS. 1 to 3, a vehicle 15 is shown having a side wall 16 with a door opening 17. The vehicle as fragmentally shown additionally includes a ceiling or roof 18 and a floor 19.

A pair of door leaves 22 and 23 are illustrated in open position in FIGS. 1 and 2 and in closed position in FIG. 3 relative the door opening 17. For purposes of enhancing the seal of the door leaves relative one another and relative the opening, resilient edges are provided along the leading and trailing edges of the door leaves. Further, the resilient door edges facilitate the removal of a person's clothing that might be caught therebetween relative the door leaves and especially at the adjacent edges.

The door leaves 22 and 23 are pivotally mounted on one end of upper and lower supporting arms. The door leaf 22 is carried by supporting arms 26 and 27, while the door leaf 23 is carried by supporting arms 28 and 29, all of which are movable laterally of the vehicle. As seen in FIGS. 1 to 3, the outer ends of the supporting arms are pivotally connected to the door leaves intermediate their leading and trailing edges and at their upper and lower edges, while the inner ends of the supporting arms 26 and 27 are secured to the top and bottom ends of a rotatably mounted shaft 30. Similarly, the inner ends of the supporting arms 28 and 29 are connected to the top and bottom ends of a vertically oriented and rotatable shaft 31. The shafts 30 and 31 are suitably rotatably supported on the vehicle.

The door operator of the invention, generally designated by the numeral 35, is mounted on a base plate 36 that is suitably carried by the frame of the vehicle and simultaneously drives, through linkage as will be hereinafter more particularly described, crank arms 37 and 38 which are respectively connected to the door supporting shafts 30 and 31. Links 39 and 40 pivotally connected at their outer ends to the trailing edges of the door leaves 22 and 23 and pivotally connected at their inner ends to a part of the frame of the vehicle serve to guide movement of the door leaves between open and closed positions and effectively coact with the supporting arms to provide a parallel linkage arrangement whereby the door leaves move through parallel planes between open and closed positions. It should be appreciated that the door operator of the invention is merely illustrated here in connection with parallel linkage mounted door leaves and that it will equally apply to door leaves pivotally or otherwise mounted on a vehicle.

The door operator 35, as shown more completely in FIGS. 4, 5, 6, 11, 12 and 13, includes generally a driven hub or hub and arm assembly 45, a drive hub or hub and cam assembly 46, a locking mechanism having a locking arm or latch arm 47, a prime mover 48, and a return spring 49. The driven hub is connected through linkages to the door leaves, while the drive hub is connected to the prime mover and the return spring. The locking arm coacts with a part of the driven hub and a part of the drive hub. The prime mover 48 shown in this embodiment is a single acting pneumatic motor but may be an electrical motor or a hydraulic motor if so desired so long as it is capable of providing a driving force to the drive hub 46. The drive hub imparts power to the driven hub for opening and closing the door leaves.

Both the driven and drive hubs 45 and 46 are rotatably mounted on a main shaft 50 extending upwardly from the base plate 36 and essentially perpendicular thereto. The locking arm 47 is pivotally mounted on an auxiliary shaft 51 also extending perpendicular to the base plate 36 and in spaced relation to the main shaft 50. The pneumatic motor 48, as well as the return spring 49, are both mounted on the base plate 36.

The driven hub 45 includes a hub 54 having an arm 55 and a locking plate 56 secured thereon and rotatable therewith. The arm 55 includes substantially equally sized arm portions 57 and 58 extending from opposite sides of the hub 54 and mounting thereon pins 59 and 60, which respectively have pivotally connected thereto one end of the connecting rods 61 and 62. The other ends of the connecting rods are respectively pivotally connected to the crank arms 38 and 37. Accordingly, rotation or pivotal movement of the driven hub 45 on the main shaft 50 will impart movement to the door leaves through the connecting rods, crank arms, supporting shafts and supporting arms.

The locking plate 56 is mounted in spaced relation above the arm 55 and includes an arcuate cam surface 65 having a locking slot or notch 66 which will coact with the locking arm 47 in a manner to be hereinafter described.

The drive hub 46 includes a hub or drive shaft 70 having mounted thereon and for corotation therewith a locking mechanism cam 71 and a drive arm 72. The cam 71 includes a nose portion 73 and an arcuate camming surface 74 for controlling the operation of the locking arm 47. Arranged above the cam 71 is the drive arm 72 which extends from one side of the hub 70 and includes thereon a pin 75 for connection to the pneumatic motor 48 and a pin 76 for connection to the return spring 49. The pin 75 extends from the upper surface of the drive arm 72, while the pin 76 extends from the lower surface. The drive and driven hubs are maintained in position on the shaft by means of a split retaining ring 78.

The prime mover 48, in the form of a pneumatic motor, includes a cylinder 80 pivotally mounted at its closed end to the base plate 36 by a pin 81, a piston 82 slidably received within the cylinder 80 and a piston rod 83 connected at one end to the piston 82 and pivotally connected at the other end to the pin 75 on the drive arm 72 of the drive hub 46. A single air line 84 connects to the rod end of the cylinder for driving the piston toward the closed end when the doors are driven through an opening cycle.

The return spring 49 is connected at one end to the pin 76 on the drive arm 72 of the drive hub 46 and at the other end to a bracket 87 mounted on the base plate 36.

Figure 8:
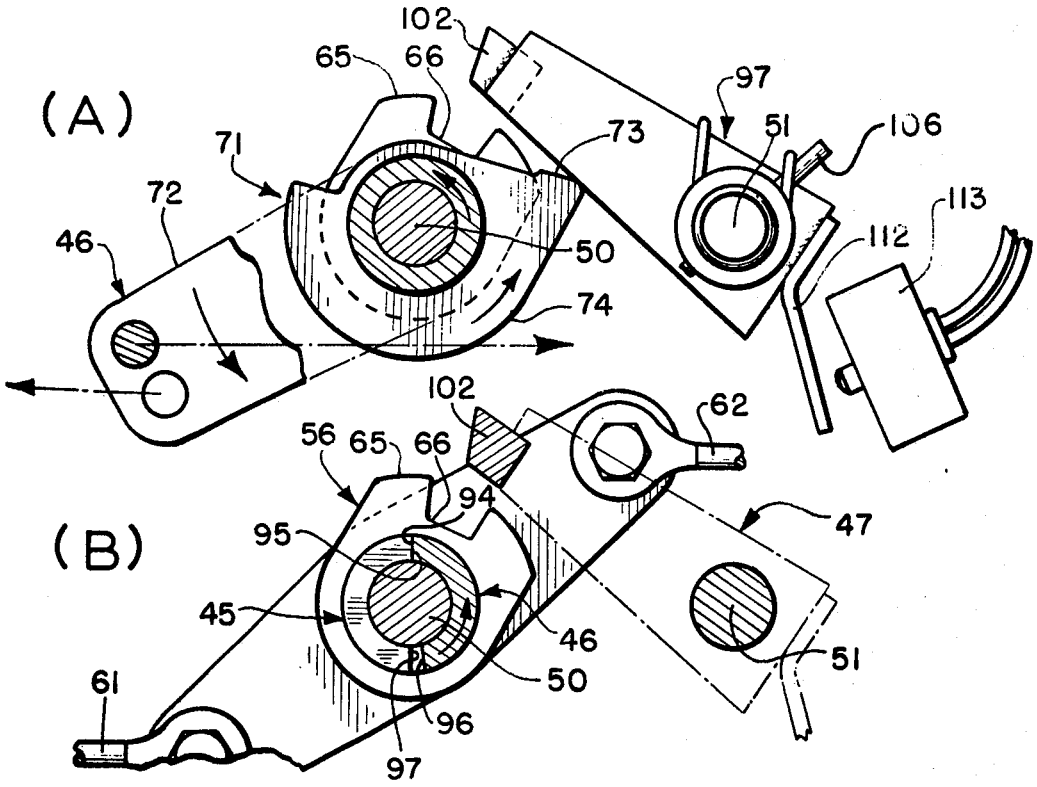
Figure 9:
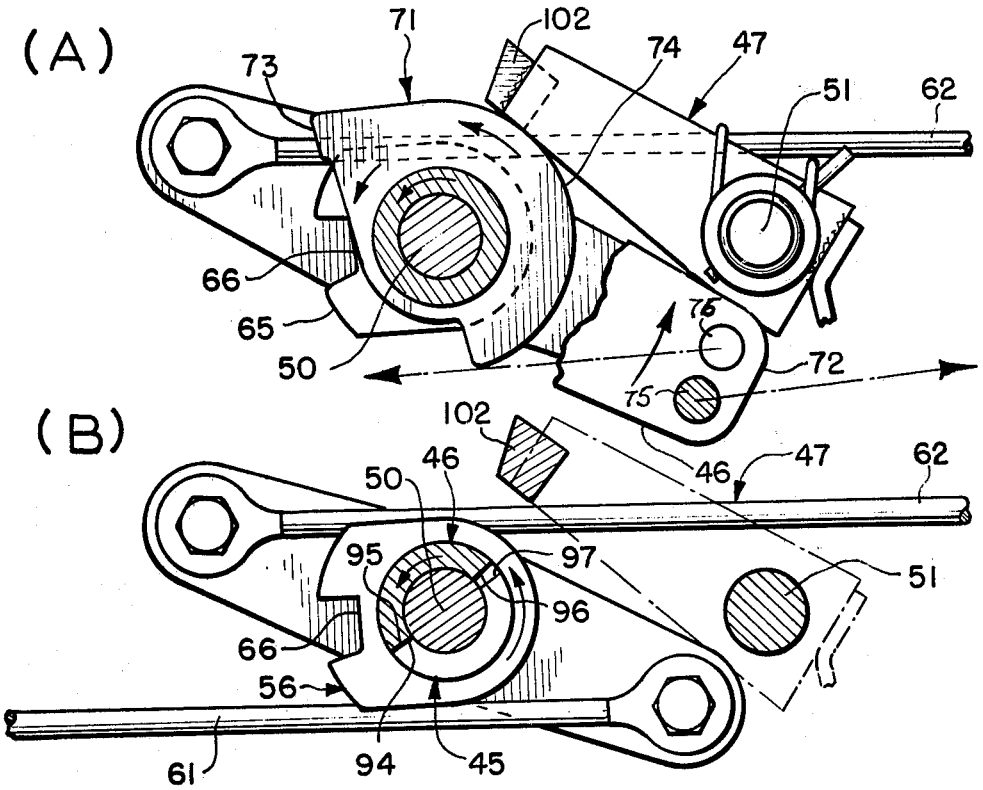
Figure 10:
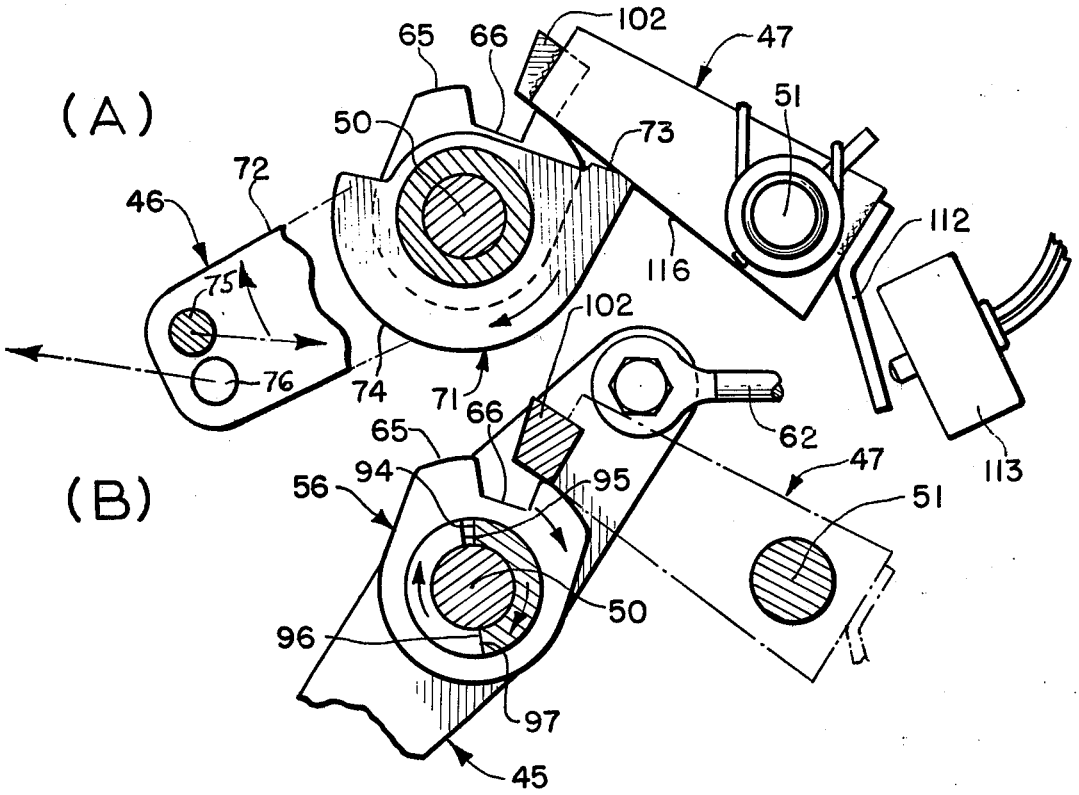

A lost motion connection is provided between the drive and driven hubs in the form of a notch or slot 90 on the hub 54 of the driven hub 45 and a notch or slot 91 on the hub 70 of the drive hub 46. As most clearly illustrated in FIGS. 12 and 13, the notch 90 has an arcuate extent of 190°, while the notch 91 has an arcuate extent of 180°, thereby defining a 10° slot or opening between the drive and driven portions of the hub when they are in mating arrangement as illustrated in FIGS. 7 to 10. Accordingly, the notch 90 defines an arcuate segment on the hub 54, while the notch 91 defines an arcuate segment on the hub 70. The arcuate extent of the segment on hub 54 is less than 180° and particularly 170° in this embodiment, while the arcuate extent of the segment on hub 70 is 180°. It will be appreciated the segment on hub 54 could be 180°, while the segment on hub 70 could be less than 180°. It should be appreciated that this 10° slot defines a take-up portion during relative movement between the drive and driven hubs when they move through the opening and closing cycles of the door operator. It should be appreciated that the 10° slot defined could be greater or less as desired and that here it merely illustrates one form capable of carrying out the features of the present invention. The notches or slots in the hubs define leading and trailing hub edges during the opening cycle. The leading edge 94 of the drive hub 46 will engage the trailing edge 95 of the driven hub 45 following the take-up of the lost motion connection, as shown in FIG. 8, to drive the doors to their fully open position, as shown in FIG. 9. During the closing cycle following the take-up of the lost motion connection, the trailing edge 96 of the drive hub 46 engages the leading edge 97 of the driven hub 45 to return the doors to the closed position.

At the beginning of the opening cycle and the completion of the closing cycle, the doors will be respectively unlocked and locked by the locking mechanism which is powered by the door operator. The locking arm 47 includes an arm 100 mounted on a hub 101 which is rotatably carried on the shaft 51. At the distal end of the arm 100 a locking pawl 102 extends laterally and downwardly for coaction with the locking slot 66 of the locking plate 56. A coil spring 103 includes a first arm 104 for engagement with the arm 100 and a second arm 105 for engagement with a pin 106 that is received in a cross bore 107 formed in the upper end of the auxiliary shaft 51. A washer 108 is also received on the shaft 51 as is the coil spring 103 and is positioned between the spring and the pin 106. Accordingly, the locking arm 47 is not only maintained on the auxiliary shaft 51 against movement from the shaft but also biased for pivotal movement in a counter-clockwise direction as viewed in FIGS. 7 to 10 by the spring 103.

Figure 4:
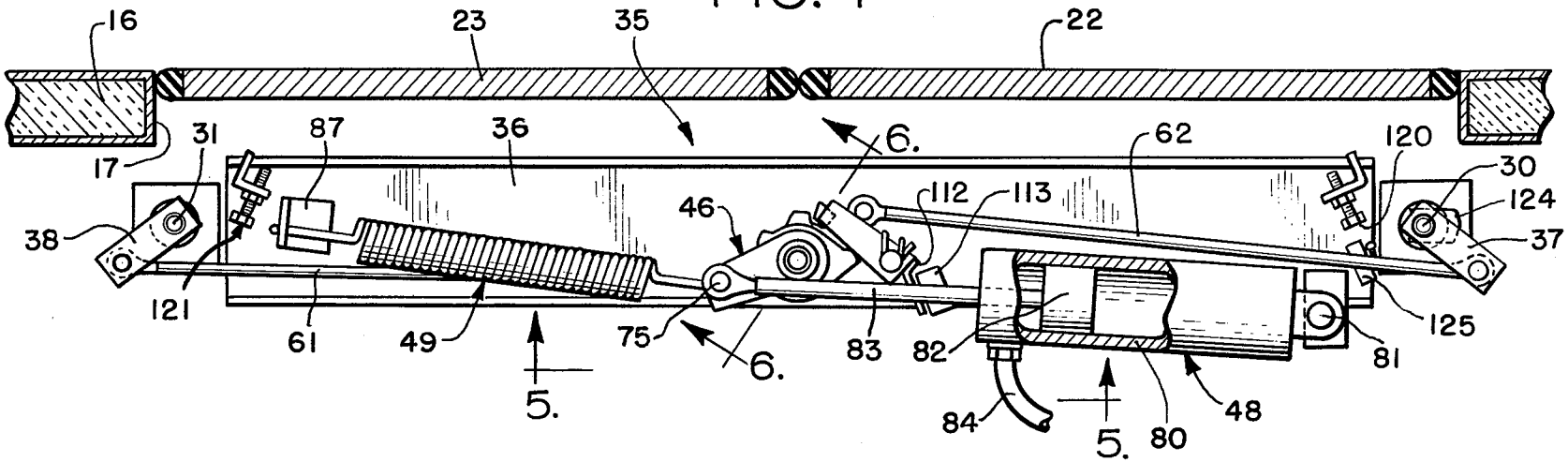
FIG. 4 is an enlarged top plan view of the door operator according to the invention with some parts broken away, together with a horizontal section through the vehicle doors and side wall, and showing the position of the operator elements when the doors are in closed position.
Figure 5:
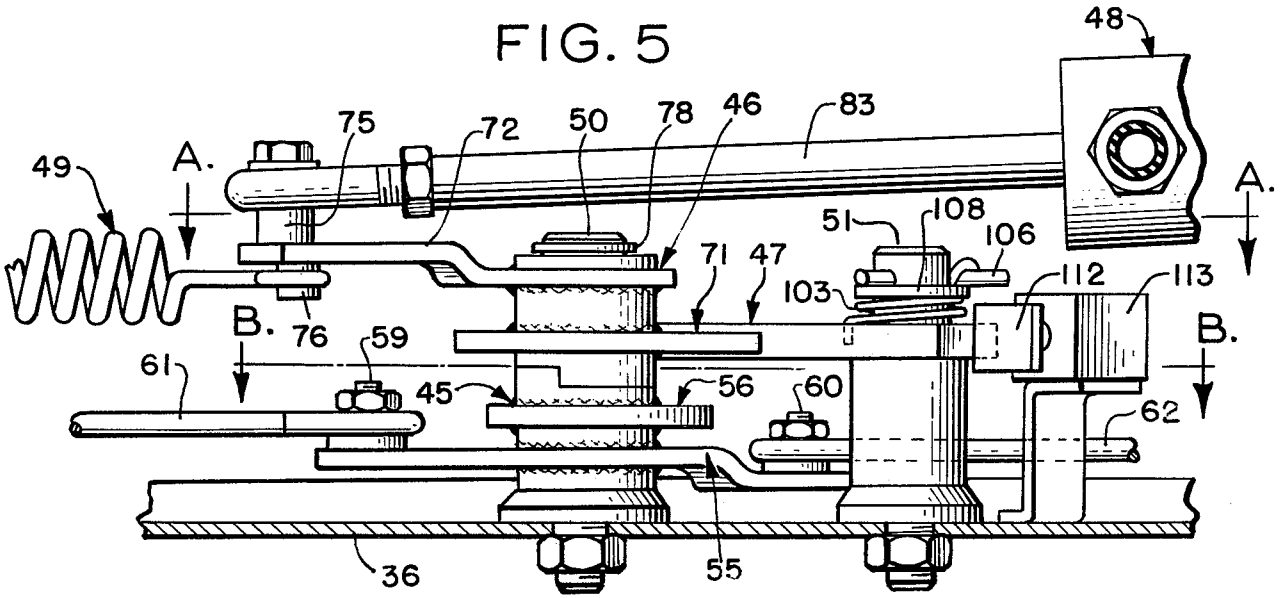
FIG. 5 is a further enlarged elevational view of a portion of the door operator according to the invention as taken along line 5—5 of FIG. 4.
Figure 6:
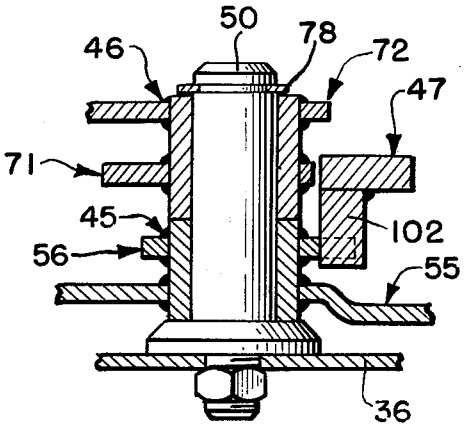
FIG. 6 is a vertical sectional view taken substantially along line 6—6 of FIG. 4.
Figure 7:
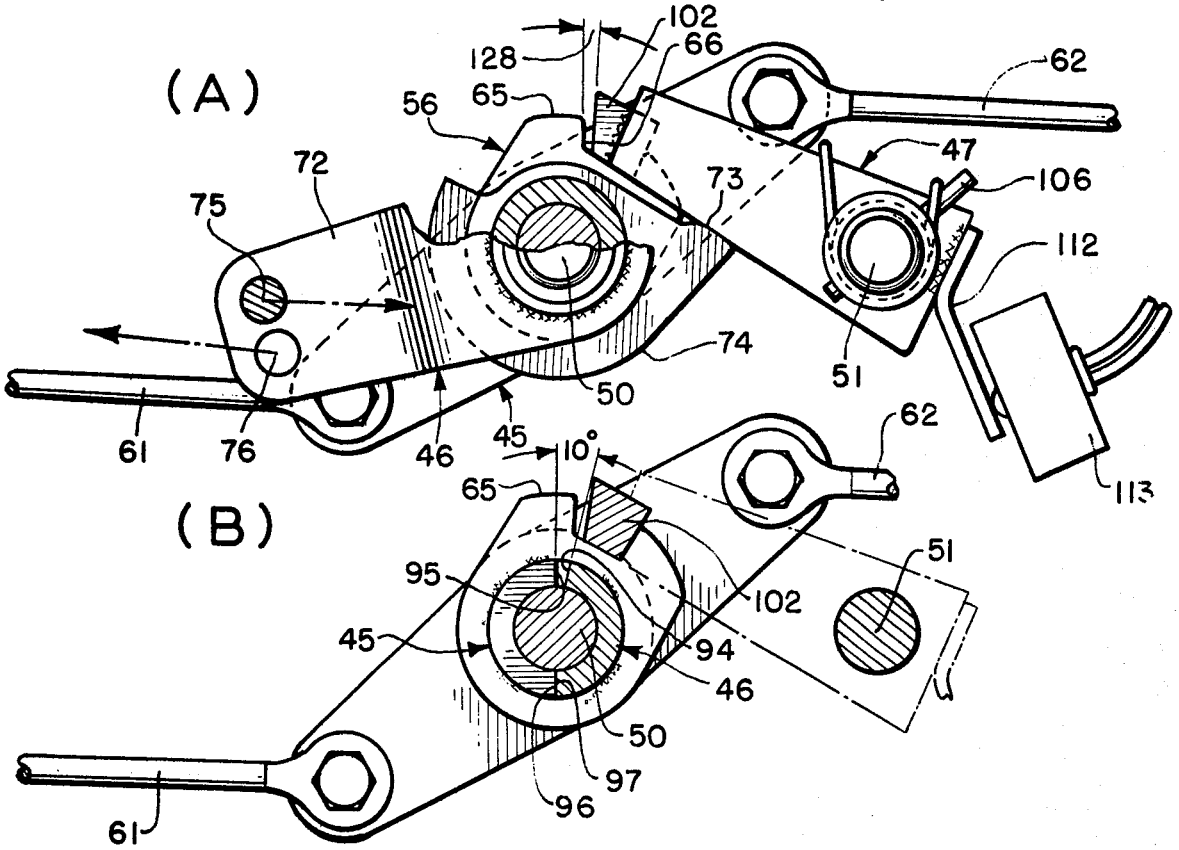
FIGS. 7 to 10 illustrate the operation of the door operator according to the invention and are sectional views taken substantially along lines A—A and B—B of FIG. 5.

A switch actuating plate 112 is secured to the arm 100 of the locking arm 47 for actuating a detecting switch 113 which is actuated and detects when the locking arm 47 is in fully locked position, as shown in FIGS. 4 and 7, to indicate to the operator of the vehicle that the doors are in closed and locked position.

It can be further appreciated that the locking mechanism cam 71 aligns with the arm 100 of the locking arm 47 to engage along the edge 116 during operation of the door operator for driving the locking arm into unlocked position and allowing it to come back into locked position. The nose portion 73 of the cam 71 functions to move the locking arm 47 into unlocked position during the take-up of the lost motion connection at the beginning of the opening cycle, while the arcuate portion 74 of the cam maintains the arm 100 of the locking arm 47 in a de-energized position thereafter during the completion of the opening cycle and much of the closing cycle, as illustrated in FIGS. 7 to 10.

During the operation of the door operator, the doors are unlocked and opened by actuation of the prime mover which is the pneumatic motor 48 and closed and locked by the return spring 49. Suitable electrical circuitry and air valves are provided for controlling the operation of the door wherein following an opening signal the pneumatic motor 48 is energized and provided with a source of air pressure to commence the opening cycle. As the piston 82 and piston rod 83 of the motor 48 start moving toward the closed end of the motor cylinder 80, a counter-clockwise force is applied to the drive hub 46. The position of the elements of the door operator when the doors are closed and locked are shown in FIGS. 7(A) and 7(B) wherein it is seen that the leading edge 94 of the drive hub is separated from the trailing edge 95 of the driven hub by ten degrees to define the lost motion connection. The take-up of this lost motion connection in the initial movement of the drive hub by the pneumatic motor causes rotation of the locking cam 71 to drive the locking arm 47 in a clockwise direction on the shaft 51 and disengage the pawl 102 from the locking slot 66 on the locking cam 56 of the driven hub 45. Accordingly, at the end of a 10° counter-clockwise movement of the drive hub 46, the doors are unlocked and ready to be opened, as illustrated in FIGS. 8(A) and 8(B) where it is seen that the leading edge 94 of the drive hub 46 now engages trailing edge 95 of the driven hub 45.

Continued operation of the pneumatic motor 48 thereafter causes opening of the door leaves to their fully open position since the drive hub is then directly connected to the driven hub and the driven hub is linkage connected to the door leaves. In order to limit the opening movement of the door leaves through the door operator, adjustable stops 120 and 121 mounted on the base plate 36, as seen in FIG. 4, are engaged by the crank arms 37 and 38. Moreover, a switch actuator 124 mounted on the shaft 30 will engage a limit switch 125 to signal the circuitry and disconnect the pneumatic motor from an air supply and connect it to an exhaust so that the spring 49 can then initiate the return cycle or closing cycle of the door leaves. It should be appreciated that the force effected by the pneumatic motor 48 is of such a magnitude that it can overcome the force generated by the return spring 49 and that the strength of the return spring is such as to cause operation of the door operator through the closing cycle when the pneumatic motor is de-energized.

When the doors are in fully open position, the door operator elements take the position as shown in FIG. 9, and as the closing cycle is initiated, the take-up in the lost motion connection is first accomplished and then the trailing edge 96 of the drive hub 46 engages the leading edge 97 of the driven hub to drive the driven hub and door leaves through the closing cycle. During the last ten-degree rotation of the driven hub, the locking arm 47, by virtue of its being biased to rotate in a counter-clockwise direction, will cause the pawl 102 to drop into the locking slot 66 on the locking cam 56 and ultimately lock the doors in closed position. The position of the door operator elements when the doors are about to be closed and locked is illustrated in FIG. 10, and again, when the doors are closed and locked, the position of the door operator elements will be as shown in FIG. 7.

It should be further appreciated that in the locked position the doors can be opened slightly against the action of the return spring 49 through the take-up of the lost motion connection wherein the driven hub can be rotated in a clockwise direction through a ten-degree arc. In this respect, it will be noted in FIG. 7 that the locking slot 66 on the locking cam 56 is of such a size that the pawl 102 can move within the slot a distance of an amount equal to the ten-degree rotation of the lost motion take-up and as indicated by the numeral 128 in FIG. 7. Such would enable anything caught between the abutting edges of the door leaves to be more easily removed.

Referring now to the embodiment illustrated in FIGS. 14 to 19, another type of door operator having the self-actuated mechanical locking mechanism of the present invention is shown and which is of the type where the door in open position is or can be at a side of the operator. This operator is generally designated by the numeral 130 and is shown to be mounted horizontally on the floor of a vehicle. It can be appreciated that the operator may be mounted in a vertical or other position along a side wall of a vehicle or even adjacent the roof of a vehicle. In any of these positions, the operator may function to open and close one or more doors of the vehicle.

The operator includes a reversible electric motor 131 having connected thereto a gear box 132 with an output shaft 133. It should be appreciated that the motor 131 could be pneumatic or hydraulic if desired. A drive arm or multiplying lever 134 is bearingly supported on the output shaft or drive shaft 133. Accordingly, there is no direct connection between the drive shaft and the drive arm. A roller 135 is mounted at the outer end of the drive arm 134 and received in a vertical track 136 mounted on a door or door leaf 137 movable relative a suitable door opening. Accordingly, movement of the drive arm will cause movement of the door 137 between open and closed positions. It may be appreciated for purposes of explanation that the drive arm may be considered in open or closed positions when the door is respectively in open or closed positions.

The mechanism for locking the door in closed position is mounted on and built into the door operator and locks the door in closed position by virtue of effecting a locking action on the drive arm 134. This mechanism is essentially the same as in the embodiment of FIGS. 1 to 13. The locking mechanism includes a locking pawl 138 in the form of an arm pivotally mounted at one end on an auxiliary shaft or pin 139 which extends parallel to the drive shaft 133 and is supported on the base of the door operator. The free end of the locking pawl includes a laterally extending locking lug 140 which coacts with a stop or lug 141 extending from one side of the drive arm 134.

Figure 17:
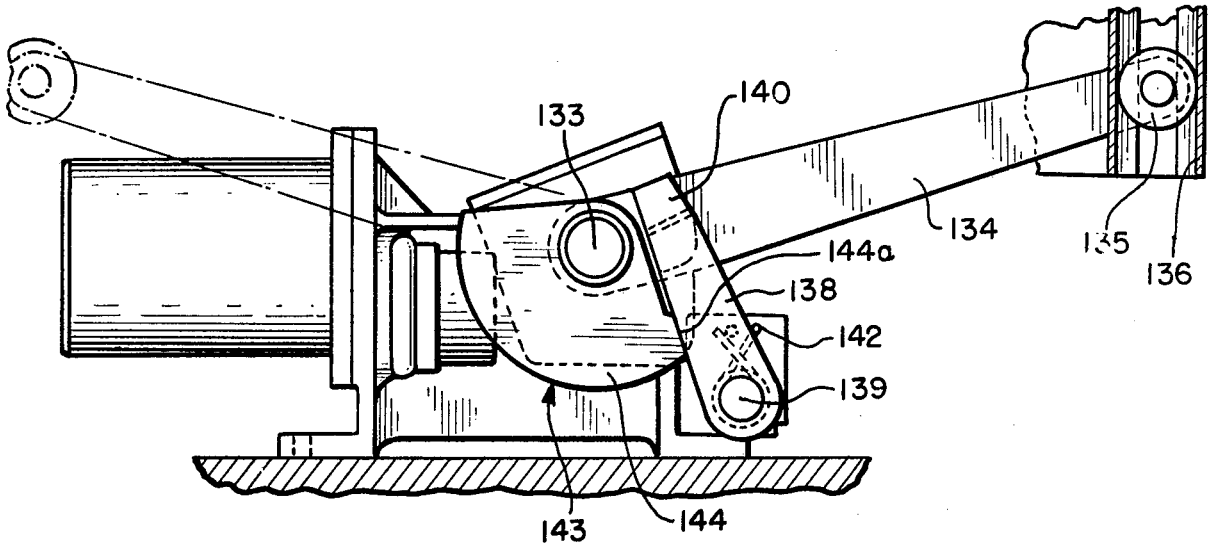
FIG. 17 is a front elevational view of the operator of FIG. 14 and showing the position of parts of the operator in solid with the door in closed and locked position and illustrating in phantom the position of the drive arm when the door is in fully open position.

When the locking pawl is in locked position as shown in FIG. 17, the locking lug 140 overlies face **141*a* of the drive arm lug 141 and prevents movement of the drive arm 134. However, a gap may be provided between the locking lug face 140*a* and the face 141*a* of the drive arm lug to allow some movement of the drive arm when the door is in closed position such as to permit extrication of any obstruction between the edge of the door and a door jamb or between the edge of a door and a second door. The weight of the drive arm by virtue of gravitational force would urge the door toward closed position and define the gap. Alternately, a light spring could be mounted to bias the door to closed position. A spring 142 is provided and interconnected between the locking pawl 138 and the base of the door operator to continually exert a biasing force to the locking pawl in a counter-clockwise direction and to normally urge the locking pawl into locked position. Accordingly, movement of the locking pawl to unlock position must be accomplished by a force opposing the force of the spring 142**.

Figure 16:
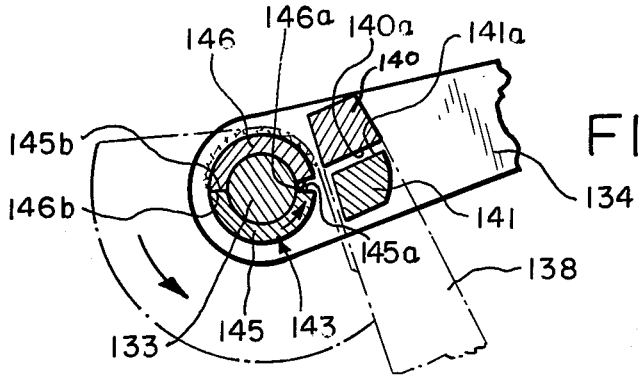
FIG. 16 is a vertical sectional view showing in detail a part of the drive mechanism of the operator and taken substantially along line 16—16 of FIG. 15.
Figure 18:
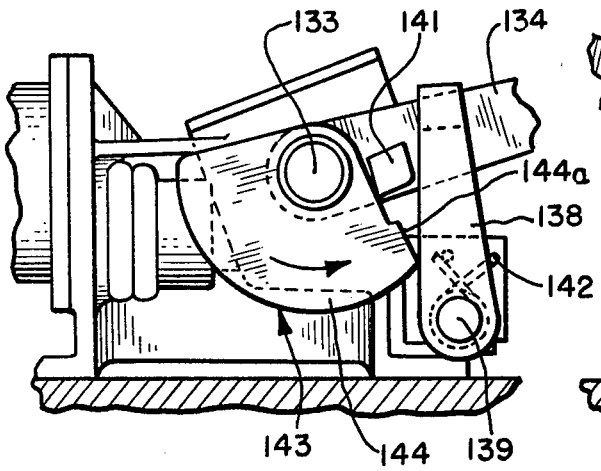
FIG. 18 is a fragmentary detailed elevational view of the operator showing the position of parts of the operator when the door is in closed and unlocked position.
Figure 19:
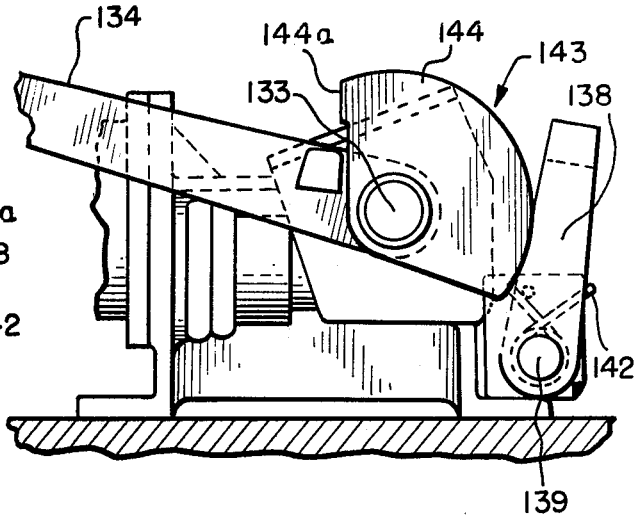
FIG. 19 is a view similar to FIG. 18 but showing the position of parts of the operator when the doors are in fully open position.

The locking pawl 138 is driven to unlock position and maintained in unlock position during the driving of the drive arm between open and closed positions. A combination cam locking and drive member 143 is connected directly to the output shaft 133 and corotates therewith. The cam locking and drive member includes a cam plate 144 having a nose portion 144*a* and an inwardly extending drive hub 145 of an arcuate extent of 180° with a leading edge 145*a* and a trailing edge 145*b*, as seen in FIG. 16. The drive hub 145 coacts with a driven hub 146 having an arcuate extent of 170° and integral with a support hub 147 for the drive arm 134. The driven hub 146 includes a trailing edge 146*a* and a leading edge 146*b*. The drive and driven hubs 145 and 146 operate the same as the drive and driven hubs of the embodiment of FIGS. 1 to 13 in that a lost motion connection is established between the drive and driven hubs. This lost motion connection is taken up during the initial driving of the output shaft 133 and the combination cam locking and drive member 143 during which time the locking pawl 138 is moved to unlock position, as shown in FIG. 18. Thereafter, continued rotation of the output shaft effects a solid connection with the drive arm 134 and drives the drive arm counter-clockwise as viewed in FIGS. 16 to 19 to the open position, as indicated in phantom in FIG. 17, until the parts take the position shown in FIG. 19. Further, during the opening cycle of the operator, the cam plate 144 maintains the locking pawl 138 in unlock or unlatch position, as shown in FIG. 19.

Figure 14:
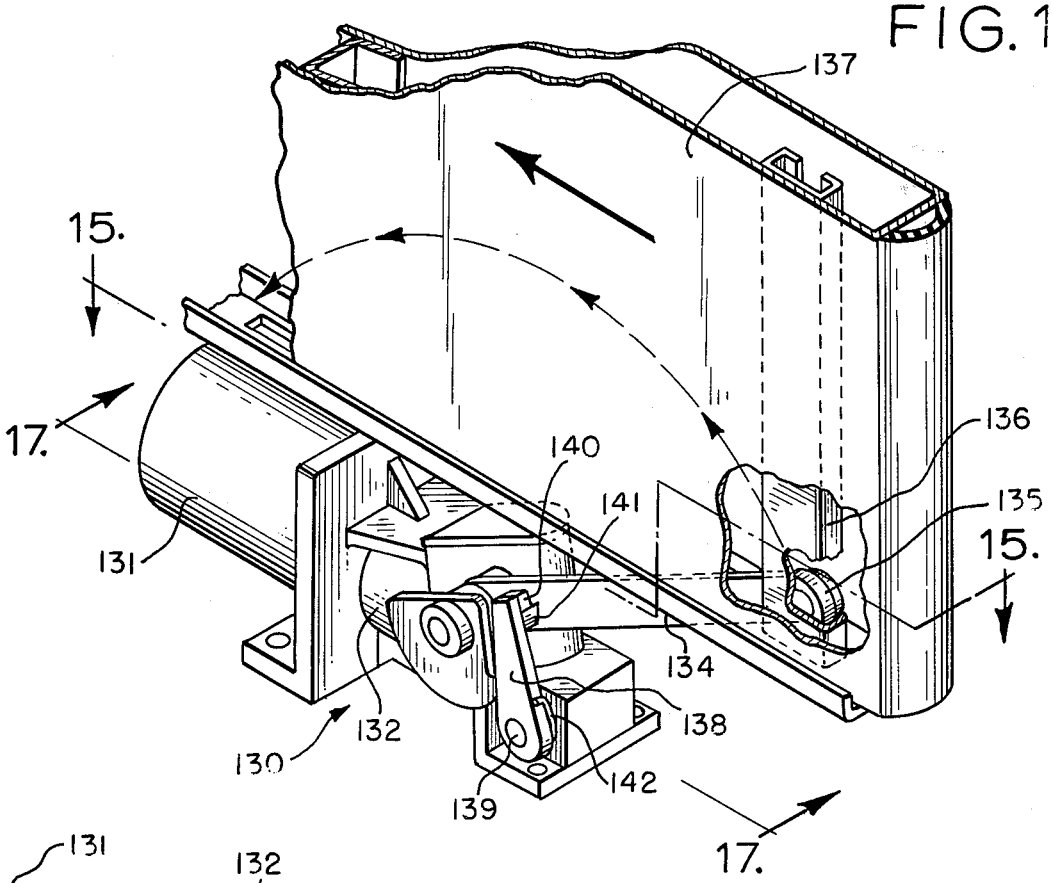
FIG. 14 is a perspective view of another form of door operator which includes the positive mechanical locking mechanism according to the present invention and illustrating fragmentarily a door connected to the operator and the operator in closed position.
Figure 15:
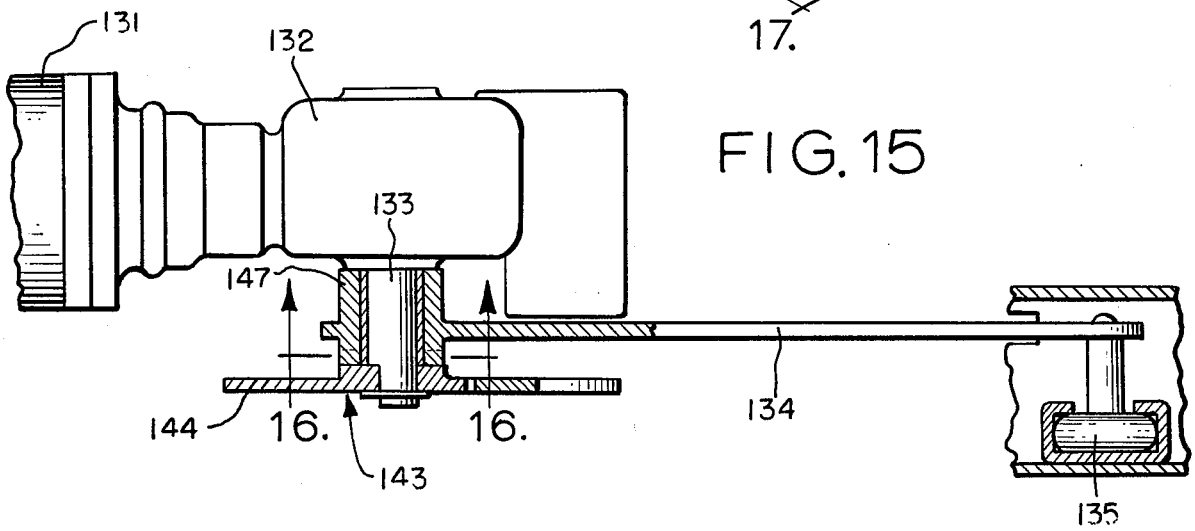
FIG. 15 is a horizontal sectional view taken through part of the operator of FIG. 14 and taken generally along line 15—15 of FIG. 14.

During the closing cycle of the operator, take-up in the lost motion connection is effected between the edges 145*b* and 146*b* of the drive and driven hubs respectively to then cause movement of the drive arm 134 toward and into closed position to also thereby close the door connection thereto. As the drive arm and door reach fully closed position, it will be appreciated that the cam 144 allows the locking pawl 138 to move into locked position by the action of the spring 142 whereby the locking lug 140 once again overlies the stop or lug 141 on the drive arm 134, as seen in FIGS. 14, 16 and 17.

The operator may be arranged relative the door as illustrated where the operator is positioned below the door, or the operator may be positioned above or to one side of the door if desired.

Accordingly, it can be recognized that the mechanical locking mechanism for a door operator according to the invention may be utilized with any type of operator where a suitable power is provided for driving a drive member that is coaxially aligned with a driven member wherein the drive member functions to automatically control the locking action during the start of the opening cycle and end of the closing cycle.

It will be understood that modifications and variations may be effected without departing from the scope of the novel concepts of the present invention, but it is understood that this application is to be limited only by the scope of the appended claims.

The invention is hereby claimed as follows:

1. A door operator for controlling the opening and closing of a door for a door opening comprising, a rotatable drive member, means for driving the drive member in opposite directions through opening and closing cycles, a driven member mounted for rotation coaxially with the drive member and being connected to said door to move with the door between open and closed positions, a locking member mounted on the driven member, a locking pawl adjacent the drive member mounted for pivotal movement between lock and unlock positions and coacting with the locking member to lock the driven member in closed position, said drive member having means for moving the locking pawl between lock and unlock positions with respect to the locking member, driven means in the form of an arcuate segment of 180° on the driven member for coaxially interengaging with drive means in the form of an arcuate segment of less than 180° on the drive member to define a lost motion connection therebetween wherein initial movement of the drive member causes movement of the locking pawl to unlock position and take-up of the lost motion connection and further movement of the drive member causes movement of the driven member toward open position.

2. A door operator as defined in claim 1, wherein said means driving the drive member includes a reversible motor.

3. A door operator as defined in claim 1, wherein said means driving the drive member includes a motor for driving the drive member through the opening cycle and a spring for driving the drive member through the closing cycle.

4. A door operator as defined in claim 3, wherein the motor is pneumatically actuated.

5. A door operator as defined in claim 1, wherein said drive member includes a drive shaft and said means for moving the locking pawl includes a combination cam locking and drive plate mounted on the drive shaft for corotation therewith, and said driven member is rotatably mounted on said drive shaft.

6. A door operator as defined in claim 5, wherein said combination cam locking and drive plate further defines said drive means on the drive member to coact with said driven means on the driven member.

7. A power open spring return door operator for controlling the opening and closing of at least one door on a vehicle, said operator comprising main and auxiliary shafts, first and second hub members rotatably mounted on said main shaft and movable between first and second positions to drive the door through opening and closing cycles, a third hub member rotatably mounted on the auxiliary shaft and movable between lock and unlock positions to lock the door in closed position, means interconnecting said first hub member to said door whereby driving said first hub member between said first and second positions causes said door to move between closed and open positions, power means connected to the second hub member for driving said second hub member from said first position to said second position to drive the door through the opening cycle, spring means connected to the second hub member for driving said second hub member from said second position to said first position to drive the door through the closing cycle, means drivingly interconnecting said first and second hub members to define a lost motion connection therebetween whereby a portion of the total movement of said second hub member from the first position thereof to the second position thereof will not cause movement of said first hub member, a locking member secured on said first hub member coacting with said third hub member to lock the door in closed position while allowing limited movement of the door against the action of the spring means toward open position, and means on said second hub member for driving said third hub member to unlock position during the take-up in the lost motion connection at the initiation of the opening cycle and to allow said third hub member to move to lock position at the completion of the closing cycle.

8. The power open spring return door operator defined in claim 7, wherein means is provided to continually bias said third hub member toward locking position.

9. The power open spring return door operator defined in claim 8, wherein said operator further includes means for de-energizing the power means at the end of the opening cycle so that the spring means can return the door to closed position.

10. The power open spring return door operator defined in claim 8, wherein said first hub member includes an arm having a pin thereon for connection to the door.

11. The power open spring return door operator defined in claim 10, wherein said second hub member includes an arm with a pin for connection to the power source and a pin for connection to the spring means.

12. The power open spring return door operator defined in claim 7, wherein said power source includes a pneumatic motor.

13. The power open spring return door operator defined in claim 7, wherein said means driving said third hub member includes a cam engageable with said third hub member.

14. The power open spring return door operator defined in claim 7, wherein said locking member on said first hub member includes a slotted plate and said third hub member includes a pawl for engagement with said slotted plate.

15. The power open spring return door operator defined in claim 7, which further includes means for limiting the open position of the door.

16. A power open spring return door operator for controlling the opening and closing of a pair of doors relative an opening in a vehicle, said operator comprising a base plate secured to the vehicle, parallel main and auxiliary shafts extending from the base plate, drive and driven hub assemblies rotatably mounted on said main shaft and movable between first and second positions to drive the doors through opening and closing cycles, a locking hub assembly rotatably mounted on the auxiliary shaft and movable between lock and unlock positions to lock the door in closed position, means connecting said driven hub assembly to said doors whereby driving said driven hub assembly between said first and second positions causes said door to move between closed and open positions, power means mounted on said base and drivingly connected to said drive hub assembly for driving said driven hub assembly from said first position to said second position to drive the door through the opening cycle, a spring connected between the base plate and the drive hub assembly for driving said driven hub assembly from said second position to said first position to drive the doors through the closing cycle, means drivingly interconnecting said drive and driven hub assemblies to define a lost motion connection therebetween whereby a portion of the total movement of said drive hub assembly from the first position thereof to the second position thereof will not cause movement of said driven hub assembly, a locking member secured on said driven hub assembly coacting with said locking hub assembly to lock the doors in closed position while allowing limited movement of the doors against the action of the spring toward open position, and means on the driven hub assembly for driving said locking hub assembly to unlock position during the take-up in the lost motion connection at the initiation of the opening cycle and to allow said locking hub assembly to move to lock position at the completion of the closing cycle.

17. The door operator defined in claim 16, wherein said locking member on said driven hub assembly is in the form of a lock plate having a radially outwardly opening slot, said locking hub assembly includes an arm with a pawl thereon for engagement in said slot, and means is provided to continually bias said arm such that the pawl is urged toward the lock plate.

18. The door operator defined in claim 16, wherein said means connecting said driven hub assembly to said doors includes arms extending from said hub assembly, pins on said arms, and connecting rods pivotally connected at one end to said pins and drivingly connected to said doors.

19. The door operator defined in claim 16, wherein said drive hub assembly includes an arm extending therefrom with a first pin thereon for connection to the power means and a second pin thereon for connection to said spring.

20. The door operator defined in claim 19, wherein said power means includes a pneumatic motor.

21. The door operator defined in claim 16, which further includes stop means on said base plate for limiting the open position of the doors.

22. The door operator defined in claim 16, wherein said means driving said locking hub assembly includes a cam plate on said drive hub assembly and engageable with said locking hub assembly.

* * * * *